US009915453B2

(12) United States Patent
Moses

(10) Patent No.: US 9,915,453 B2
(45) Date of Patent: Mar. 13, 2018

(54) INDIRECT EVAPORATIVE COOLING SYSTEM WITH SUPPLEMENTAL CHILLER THAT CAN BE BYPASSED

(75) Inventor: Terrence J. Moses, Cincinnati, OH (US)

(73) Assignee: Systecon, Inc., West Chester, OH (US)

( * ) Notice: Subject to any disclaimer, the term of this patent is extended or adjusted under 35 U.S.C. 154(b) by 484 days.

(21) Appl. No.: 13/367,455

(22) Filed: Feb. 7, 2012

(65) Prior Publication Data

US 2013/0199222 A1 Aug. 8, 2013

(51) Int. Cl.
*F25B 1/00* (2006.01)
*F25B 41/00* (2006.01)

(52) U.S. Cl.
CPC ..... *F25B 41/00* (2013.01)

(58) Field of Classification Search
CPC ..... F25B 41/00; F25B 25/005; F25B 25/02; F25B 7/00
USPC ..... 62/115, 97, 325, 98, 99
See application file for complete search history.

(56) References Cited

U.S. PATENT DOCUMENTS 3,028,735 A 4/1962 Divine et al.
3,127,928 A * 4/1964 Ringquist ..... 165/221
RE26,391 E 5/1968 McFarlan
3,636,721 A * 1/1972 Rex ..... 62/98
3,791,160 A 2/1974 Savitz et al.
3,995,443 A * 12/1976 Iversen ..... F24F 3/06 165/299
4,165,619 A * 8/1979 Girard ..... 62/99
4,201,062 A 5/1980 Martinez, Jr.
4,277,952 A 7/1981 Martinez, Jr.
4,283,921 A * 8/1981 Prosky ..... 62/126
4,406,138 A * 9/1983 Nelson ..... F24F 5/001 62/119
4,457,358 A * 7/1984 Kriege et al. ..... 165/50
4,516,408 A 5/1985 Chiba
4,653,287 A * 3/1987 Martin, Jr. ..... 62/181
4,679,411 A 7/1987 Pearse, Jr.
4,766,735 A 8/1988 Gotou
4,878,357 A 11/1989 Sekigami et al.
5,005,371 A * 4/1991 Yonezawa et al. ..... 62/238.6
5,239,838 A 8/1993 Tressler
5,291,941 A 3/1994 Enomoto et al.
5,613,372 A 3/1997 Beal et al.
5,622,057 A 4/1997 Bussjager et al.
5,755,104 A 5/1998 Rafalovich et al.
5,829,262 A 11/1998 Urata et al.
6,237,351 B1 5/2001 Itoh et al.
6,536,221 B2 3/2003 James
6,539,736 B1 4/2003 Isazawa et al.
6,658,874 B1 12/2003 Trent
(Continued)

FOREIGN PATENT DOCUMENTS

JP 10185342 7/1998

*Primary Examiner* — David Teitelbaum
(74) *Attorney, Agent, or Firm* — Jason H. Foster; Kremblas & Foster

(57) ABSTRACT

An efficient indirect building cooling system that bypasses a conventional chiller mechanism by connecting the indoor and outdoor intermediate fluid systems when conditions permit. This system includes indoor and outdoor fluid cooling circuits, each of which interfaces with the conventional chiller mechanism. The two fluid cooling circuits are connected together when weather conditions make doing so more efficient.

5 Claims, 2 Drawing Sheets

(56) References Cited

U.S. PATENT DOCUMENTS

| | | | | |
|---|---|---|---|---|
| 6,701,731 | B2 | 3/2004 | Aikawa et al. | |
| 6,857,286 | B2 | 2/2005 | Ohta et al. | |
| 6,871,509 | B2 | 3/2005 | Grabon et al. | |
| 7,007,495 | B2 | 3/2006 | Lee et al. | |
| 7,293,425 | B2 | 11/2007 | Tamura et al. | |
| 7,797,954 | B2 | 9/2010 | Duhme et al. | |
| 2006/0107683 | A1* | 5/2006 | Song | F24F 3/06 62/324.1 |
| 2010/0050669 | A1 | 3/2010 | Poux et al. | |
| 2010/0070082 | A1 | 3/2010 | Chessel et al. | |

* cited by examiner

INDIRECT EVAPORATIVE COOLING SYSTEM WITH SUPPLEMENTAL CHILLER THAT CAN BE BYPASSED

BACKGROUND OF THE INVENTION

The invention relates to a cooling system for buildings, and more particularly to a cooling system that uses indirect evaporative cooling with a supplemental chilling mechanism.

Conventional refrigeration ("cooling") units used to cool buildings, automobiles and other places in which people, computers or other items dwell at maximum acceptable temperatures utilize the Carnot cycle. In such a conventional cooling unit, a compressor is used to cyclically compress and expand a fluid ("refrigerant"), thereby changing the refrigerant's temperature, in order to transfer thermal energy ("heat") from air inside the building to air outside the building. During the cycle, the temperature of the refrigerant is reduced well below the temperature of the indoor air so that heat is transferred to the refrigerant when air is blown across thermally conductive heat exchangers the refrigerant flows through. The refrigerant temperature is next increased well above the temperature of the outdoor air so that heat is transferred from the refrigerant to the outdoor air when air is blown across thermally conductive heat exchangers the refrigerant flows through.

The conventional Carnot cycle refrigeration mechanism has four main components, as illustrated schematically in FIG. 1: an evaporator 10, a compressor 20, a condenser 30 and an expansion device 40. These components are connected by fluid conduits 12, 22, 32 and 42 that contain the refrigerant in liquid and gas states and convey the refrigerant from one component to the next without permitting significant atmospheric contamination by refrigerant or significant contamination of the refrigerant by atmospheric matter. The components of the refrigeration mechanism, and its operation, are explained below beginning with the evaporator 10. Although the operation begins with the evaporator, it will be understood that the mechanism is continuous and cyclical, and the explanation below starting with one component does not suggest a "beginning" or "end".

The evaporator 10 is a heat transfer device that transfers heat in the warmer indoor air to the cold refrigerant. The refrigerant in the evaporator can cool air directly in the case of an air cooling coil, which is an air-to-refrigerant heat exchanger commonly found in home air conditioning units. Alternatively, the refrigerant in the evaporator can cool the air indirectly using an intermediate fluid, such as water or glycol in the case of water chillers used in skyscrapers and factories. The intermediate fluid of an indirect system's indoor water circuit 16 can then be pumped to heat exchangers 14 in many locations where the refrigerant can cool the air with air-to-water cooling coils. The warmed water is then pumped by the electric pump 18 to a water-to-refrigerant heat exchanger, such as the evaporator 10, where the water is cooled when the refrigerant absorbs the heat. In the evaporator 10, the liquid refrigerant evaporates due to the absorption of heat from the water.

After the warmed gaseous refrigerant leaves the evaporator, it flows along the conduit 12 to the compressor 20. The compressor compresses the refrigerant significantly to increase its pressure, thereby increasing the temperature of the refrigerant due to well-known laws of chemistry (e.g., the ideal gas law: PV=nRT). Hot refrigerant exits the compressor and flows toward the condenser 30.

The condenser 30 is also a heat transfer device, and the condenser transfers heat from the hot refrigerant to the outdoor air. The refrigerant in the condenser can heat the outdoor air directly in the case of an air-to-refrigerant heat exchanger commonly found in home air conditioning units. In such a direct condenser, a coil is placed outdoors and the outdoor air is drawn over the coil using an electric fan, thereby cooling the refrigerant in the coil. Alternatively, the refrigerant in the condenser can heat the outdoor air indirectly using an intermediate fluid, such as water that flows through an outdoor water circuit 36, to cool the refrigerant in a water-to-refrigerant heat exchanger, and then is pumped by the electric pump 38 to an outdoor air-to-water heat exchanger 34. In both the direct and indirect condensers, the refrigerant is cooled sufficiently to cause condensation of the refrigerant to a liquid phase that remains at high pressure.

The high pressure, relatively cool liquid refrigerant flows through the conduit 32 to an expansion device 40. The expansion device is typically a valve/orifice that meters the flow of refrigerant through the conduit. That is, the refrigerant cannot flow without restriction through the orifice, but is metered by the viscosity of the fluid and the size of the orifice that cause the pressure on one side of the orifice to be much higher than on the other side of the orifice. The pressure of the refrigerant on the downstream (evaporator) side of the expansion device 40 is significantly lower than on the upstream side of the expansion device. This significant reduction in pressure (prior to the refrigerant entering the evaporator) causes a significant drop in the temperature of the refrigerant, which permits the cold refrigerant to absorb heat when it enters the evaporator 10 and begins the cycle again.

Outdoor air can be used to cool the refrigerant in the condenser directly by simply placing the condenser coil outdoors and directing outdoor air across it. A variation of this "outdoor chiller" is an evaporative condenser in which the outdoor coil is sprayed with water to further cool the refrigerant. In both of these "direct" configurations, no intermediate fluid is utilized between the refrigerant and the outdoor air.

Conventional cooling systems used in large buildings use "indirect" cooling for a safer and more efficient system. Using non-toxic water or other fluid pumped in an indoor circuit throughout the building from the water-to-refrigerant evaporator 10, any or all parts of the building can be cooled safely by connecting a water-to-air heat exchanger 14 to a water line that is part of the indoor evaporator circuit 16. The cool water is pumped to the room to be cooled, and air is drawn across the coils of the heat exchanger 14, thereby cooling the room air as the water thus absorbs heat from the room's air. The water is then pumped back to the evaporator 10 to transfer its heat to the cold refrigerant. When cooling is not required in a particular room or part of the building, the water is not pumped or air is not blown over the water-to-air heat exchanger.

The condenser 30 is also indirectly cooled using non-toxic water that is pumped from the water-to-refrigerant heat exchanger (the condenser 30) to the outdoors where the heat is released. The water is the intermediate media in the outdoor condenser circuit 36 that cools the refrigerant in the water-to-refrigerant heat exchanger (condenser 30), and then the water is cooled by outdoor air in the water-to-air heat exchanger 34.

There are generally three types of devices used to cool the water with outdoor air in an outdoor condenser circuit. A fluid cooler is a large outdoor coil with a fan. The water flows through the coil and the fan draws air across the coil to cool the water. This operates in a similar manner as a conventional household air conditioning system's outdoor unit, except that the fluid cooler cools the intermediate fluid instead of refrigerant.

An evaporative cooler uses the same configuration as a fluid cooler with the addition of a separate water source that sprays water over the coil. The water evaporates, thereby cooling the air, and the colder air is drawn across the coil to cool the water in the coil more effectively. When using an indirect evaporative cooler the water that cools the condenser never comes in contact with the outdoor air because the condenser water circuit is a closed circuit. The water sprayed over the coil is collected, placed in fluid communication with the evaporative cooler's pump and is sprayed over the coil again.

The third type of water cooling device is a cooling tower, which uses a box with a large fan and "fill", which is a medium used to increase the surface area and the time of contact between the air and water. In a cooling tower, water from the condenser is cooled by spraying the water on the fill and using the large fan to cool the water. In a cooling tower, some of the water evaporates, which cools the water further. The cool water is collected in the bottom of the cooling tower (basin) where it is pumped back into the building.

The water in a conventional cooling tower is directly exposed to the outside air, which means the water becomes dirty and then flows back through the internal fluid conduits in the building. In essence, the water "cleans" outdoor air by trapping particles and chemicals in the air when the two fluids make contact. In most conventional cooling towers, an attempt is made to clean the water because dirty water will foul the water cooled condenser over time and the water-cooled condenser must be cleaned. Even with cleaning of the water, the condenser must be cleaned about once every year.

In order to avoid dirtying the water of a cooling tower, an intermediate heat exchanger is commonly used to transfer heat between the cold cooling tower water and the indoor building cooling water. These heat exchangers are typically plate and frame heat exchangers, and much care is needed to keep them clean.

BRIEF SUMMARY OF THE INVENTION

The invention contemplates an indirect evaporative cooling system with a supplemental chiller that can be bypassed in the event that the conditions warrant. An integral economizer is made possible by cooling the condenser with water. Under acceptable weather conditions the building can be completely cooled by the evaporative cooler portion of the circuit and the supplemental chiller is shut down. When weather conditions are not favorable for the evaporative cooler to perform all of the cooling, the supplemental chiller is engaged to supplement the cooling of the evaporative cooler. Thus, the building can be cooled when the outdoor conditions are not conducive to cooling by the evaporative cooler alone.

The evaporative cooler preferably uses a water spray over a closed coil. Air is drawn over the coil and the water evaporates. The evaporating water cools the air, which in turn cools the coil. The water in the coil is thus cooler than using air alone, thereby making the unit more efficient than an air-cooled chiller. The preferred unit is designed to operate with and without the evaporative water sprayed over the coil. When the outdoor conditions permit, the enhanced evaporative cooling allows more hours of "free" cooling without supplemental use of the chiller or of the water spray. This is useful to conserve water when dry outside air is sufficiently cool, and this limits the amount of water that is used by the evaporative cooler. The ability to operate without the evaporative spray also allows the water in the evaporative cooler to be drained during freezing conditions to avoid breakage and to avoid additional evaporation. In the case of a water outage, the unit is capable of running on the hottest day. This eliminates the need for redundant water storage on site or auxiliary wells.

When the outdoor conditions are capable of producing complete cooling using the evaporative cooler alone, the chiller is turned off. The water from the indoor evaporator circuit that flows through the building's internal conduits is then directed to the outdoor condenser circuit. The indoor evaporator circuit water is thus cooled by the evaporative cooler and is then pumped back to the indoor water circuit to further cool the building. The outdoor water circuit water preferably also bypasses the condenser. In this way, the water can avoid the condenser when the chiller is dormant. Alternatively, the water can pass through the condenser if it is desired.

A three-way valve is used to divert all the water in the indoor evaporator circuit to the outdoor condenser circuit. A hydraulic bridge also allows the building's indoor evaporator circuit water to mix with the water of the outdoor condenser circuit before it either enters or bypasses the condenser. Water preferably only enters the water-cooled condenser when supplemental mechanical cooling by the chiller occurs, but this can be varied if advantages arise. When there is supplemental cooling by the chiller, the water of the indoor evaporator circuit mixes with water of the outdoor condenser circuit to be further heated by the chiller's condenser and then enters the evaporative cooler outdoors. The evaporative cooler then cools the hotter water by using evaporative cooling and then is returned back to the indoor evaporator circuit, preferably just upstream of the evaporator, where it is cooled further to meet the cooling requirements of the building.

If the outdoor conditions are not favorable, the valving does not direct the water from the indoor evaporator circuit to the condenser circuit and the evaporative cooler. In this case, no free cooling is provided and the system works like a standard water-cooled chiller.

The chiller circuit uses large motors to drive the compressor, and these are expensive to operate. It is contemplated to take the refrigeration circuit out of operation when the outdoor heat exchanger is sufficient to cool the water sufficiently to cool the indoor air. This could occur when the temperature conditions outdoors are favorable, and/or when the outdoor humidity conditions are favorable to the outdoor heat exchanger having water (which is not taken from the indoor or outdoor circuits) sprayed onto the outside of the heat exchanger to cool the water flowing through the heat exchanger during evaporation of the water into the outdoor air. A computer detects the temperature, humidity, dew point and other conditions inside and outside the building to determine when to cease operation of the refrigeration cycle and permit the water circuits to bypass the refrigeration circuit.

This system is unique inasmuch as it utilizes evaporative free cooling without the use of an intermediate heat exchanger. It allows simultaneous free and mechanical cooling, which will reduce the amount of electrical energy being used. It is preferably provided in an assembled package that has all these features built in so that it can replace inefficient air-cooled systems that do not have free cooling. It is designed to limit water use by being able to run without the evaporative spray pumps being energized. This allows safe cold weather operation as well as emergency operation in the case of a water outage. It is also more efficient than an air-cooled chiller because it uses evaporative cooling. At the same time the evaporative cooling is indirect so that airborne contaminants do not enter the condenser circuit water.

Figure 1:
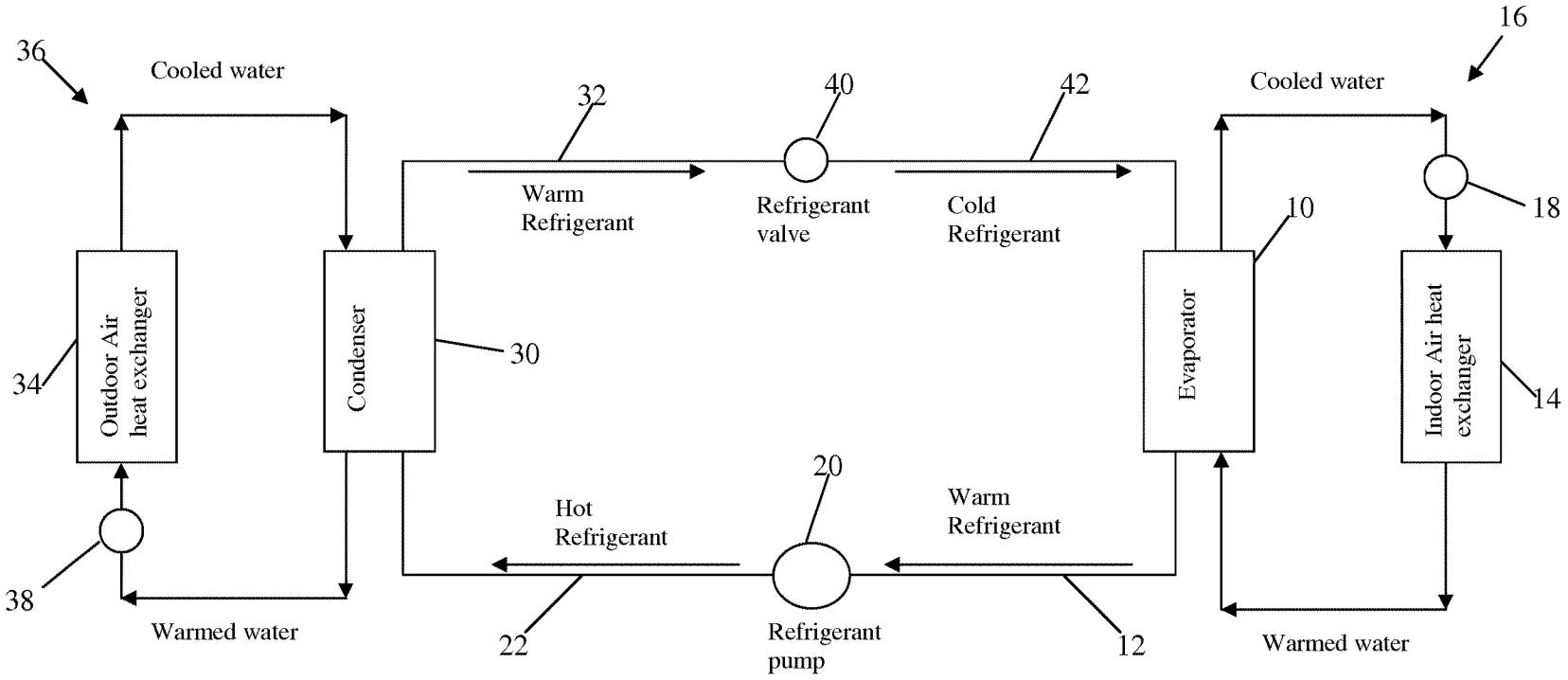
Fig. 1 (prior art)
FIG. 1 is a schematic hydraulic circuit illustrating a prior art cooling system.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose. For example, the word connected or terms similar thereto are often used. They are not limited to direct connection, but include connection through other circuit or mechanical elements where such connection is recognized as being equivalent by those skilled in the art. In addition, circuits are illustrated that are of a type that performs well known operations on fluids. Those skilled in the art will recognize that there are many, and in the future may be additional, alternative circuits that are recognized as equivalent because they provide the same operations on the fluids.

DETAILED DESCRIPTION OF THE INVENTION

Figure 2:
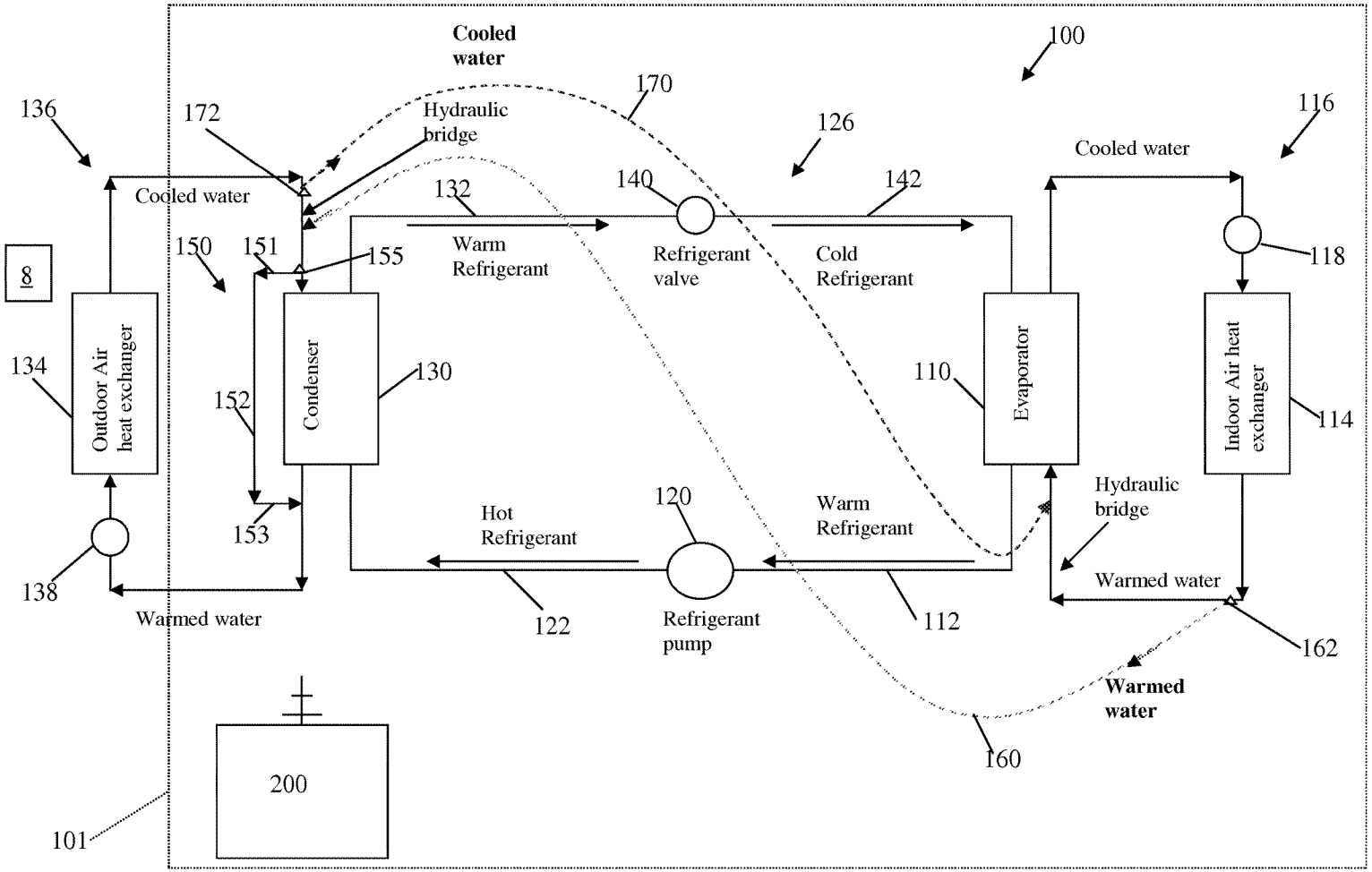
FIG. 2 is a schematic hydraulic circuit illustrating a cooling system according to the present invention.

FIG. 2 illustrates a cooling system 100 that embodies the invention and typically serves a large building, such as a skyscraper, apartment building, school, hospital or any other large building 101. The cooling system 100 can be housed within the building, outside the building or a hybrid in which some of the components are inside and some are outside. A mechanical chiller circuit 126 includes an evaporator 110, a compressor 120, a condenser 130 and a valve 140 connected by a closed loop of conduits 112, 122, 132 and 142 containing a refrigerant. The chiller circuit 126 operates in a known manner (as described above in relation to the prior art system shown in FIG. 1) to pump heat from the evaporator 110 to the condenser 130 so that the heat can be removed from the building 101 in which the chiller circuit 126 operates.

An indoor evaporator fluid circuit 116 includes the evaporator 110 and the indoor air heat exchanger 114 connected by a loop of conduit. The indoor circuit 116 is illustrated with a single heat exchanger 114, but in a typical installation there are dozens if not hundreds of heat exchangers in series and/or parallel along the indoor circuit 116. Such heat exchangers function substantially identically with the heat exchanger 114, and therefore only the heat exchanger 114 is described below. Water is the preferred intermediate fluid media that flows through the indoor circuit 116 as impelled by a conventional pump 118 connected to a central computer 200, but a water and antifreeze mixture or any other acceptable fluid can be substituted for the water. The central computer 200 is preferably a generally programmable computer, such as a personal computer, but could be a specialized computer such as a logic circuit, a mechanical computer or any equivalent.

An outdoor condenser circuit 136 includes the condenser 130 and the outdoor air heat exchanger 134 connected by a loop of conduit. The outdoor circuit 136 is illustrated with a single heat exchanger 134, which in a typical installation is an evaporative cooler with a conventional water spray system 8 that can be actuated to spray water onto a coil through which the water that is part of at least the outdoor circuit 136 flows. The sprayed water is part of neither the outdoor circuit 136 nor the indoor circuit 116. It is preferred that water flows through the outdoor circuit 136 as impelled by a conventional pump 138 connected to the central computer 200, but the water can be replaced by water including antifreeze or by any other acceptable fluid. Because the fluids of the indoor circuit 116 and the outdoor circuit 136 are mixed during at least some modes of operation of the system 100, the fluids used in the circuits 116 and 136 are preferably the same. The pumps 118 and 138, as well any other item referred to herein as connected to the central computer 200, can be connected thereto by wire or a wireless connection.

A bypass 150 is formed of the conduits 151, 152 and 153 extending from the conduit of the outdoor circuit 136 just upstream of the condenser 130 to the conduit just downstream of the condenser 130. A valve 155 is mounted at the juncture where the conduit 151 begins and controls whether fluid in the outdoor circuit 136 flows through the condenser 130 or through the bypass 150 as will be described in more detail below. The valve 155 is connected to and is operated by the central computer 200 or through the internal controls of the chiller assembly.

The bypass conduits 160 and 170 extend between the indoor circuit 116 and the outdoor circuit 136. The conduit 160 permits water to flow from the indoor circuit 116, starting at a point just downstream of the heat exchanger 114, directly to a point in the outdoor circuit 136 that is just upstream of the condenser 130. The conduit 170 permits water to flow from the outdoor circuit 136, starting at a point just upstream from the condenser 130, directly to a point in the indoor circuit 116 that is just upstream from the evaporator 110. The entry and exit points of the conduits 160 and 170 can be varied. The bypass conduits 160 and 170 are opened and closed to the circuits to which they connect by the valves 162 and 172, respectively. The valves 162 and 172 are connected to, and are actuated between the opened and closed positions by, the central computer 200. The term "downstream", as used herein, refers to a relative position in a hydraulic circuit that is farther along in the direction of fluid flow. The term "upstream", as used herein, refers to a relative position in a hydraulic circuit that is not as far along in the direction of fluid flow.

It is preferred that the central computer 200 receives signals from sensors (not illustrated) that detect various conditions within the building 101 in which the system 100 is installed, such as the temperatures in discrete portions of the building, which can be rooms or regions of the building. Furthermore, the computer 200 preferably receives information about the temperature of the fluids in the circuits 116 and 136, for example from temperature sensors (not shown). The computer 200 also receives signals from weather sensors (not shown) around the heat exchanger 134, in order to detect conditions, such as outdoor air temperature, relative humidity, dew point, wet bulb, wind speed, wind direction, barometric pressure and any other conditions desirable for the operation of the apparatus. The central computer 200 is also connected to the valves described herein, the compressor 120, the expansion valve 140 and any other controllable features of the system 100. The central computer 200 is preferably programmed to receive the condition signals and process them using algorithms to actuate, in a conventional manner, the valves, compressor and other features to which it is connected in order to optimize the operation of the system shown in FIG. 2.

The system 100 of FIG. 2 is in a state of non-operation. The system is started from a non-operational state by applying power to the central computer 200, which, once operational, begins receiving building temperature data and weather data. Based upon pre-programmed instructions, the computer actuates the system 100 into one of the modes of operation when the indoor temperature is sufficiently high to require indoor cooling.

There are three modes in which the system 100 is contemplated to operate, but there could be more than three as will be apparent to a person of ordinary skill from the description herein. First, the system 100 can operate the chiller circuit 126 without any use of the bypass conduits 160 and 170. In this operating mode, referred to as "high power mode", the compressor 120 is actuated by the central computer 200 to compress refrigerant in the chiller circuit 126, and the pump 118 in the indoor circuit 116 and the pump 138 in the outdoor circuit 136 pump water around their respective circuits. It is possible for the water sprayer 8 to operate in high power mode, but it is not required. The most electricity used in any mode of operation is used in the high power mode, and this mode of operation is typical when there is the highest load imposed on the system by the building during the weather that is the least favorable for cooling. This can be, for example, the operating mode used on a hot, humid day with little air movement, and in this mode the system 100 operates in a conventional manner without connecting the indoor circuit 116 and the outdoor circuit 136 to one another via the conduits 160 and 170 or any other fluid connection.

The second possible mode of operation is the "low power mode" and this mode occurs when the chiller circuit 126 is not operational—that is, when the compressor 120 is not powered. The low power mode includes the opening of the valves 162 and 172 that permit water to flow from the indoor circuit 116 to the outdoor circuit 136 through the conduit 160 and to return through the conduit 170. The low power mode is the operating mode in which the least amount of electrical energy is used, and is the mode selected when there is a load imposed on the system by the building when the outdoor conditions permit cooling to occur by the evaporative cooling only using the outdoor air heat exchanger 134. This mode is described in detail below.

The third mode is the "medium power mode" in which the chiller circuit 126 is operating—that is, when the compressor 120 is powered—and the valves 162 and 172 are open to permit water to flow from the indoor circuit 116 to the outdoor circuit 136 through the conduit 160 and to return through the conduit 170. The medium power mode is the operating mode in which more electrical energy is used than the low power mode, but less than the high power mode, and is typical when there is a significant load imposed on the system by the building, but when the outdoor conditions permit partial cooling by evaporative cooling using the outdoor air heat exchanger 134 and partial cooling using the mechanical chiller circuit 126. This mode is described in detail below.

In the high power mode, all thermal energy is moved from the indoor circuit 116 to the outdoor circuit 136 through the mechanical chiller circuit 126. Because thermal energy is transferred more rapidly when there is a greater temperature differential between the source of the energy and the destination, the chiller circuit 126 can transfer energy rapidly between the indoor circuit 116 and the outdoor circuit 136. This comes at a cost, however, because it takes substantial electrical energy to drive a conventional compressor. Nevertheless, this energy input provides the temperature differential when the refrigerant becomes extremely hot so that the refrigerant transfers substantial thermal energy to the water in the outdoor circuit 136 when the refrigerant and water flow through the condenser 130. Subsequently, when the cooled refrigerant expands in the valve 140, the refrigerant reaches a very cold temperature to significantly cool the water in the indoor circuit 116 when both fluids pass through the evaporator 110. This provides a significant temperature differential allowing the refrigerant to receive substantial thermal energy from the water in the indoor circuit 116. Thus, the high energy mode is very effective at pumping thermal energy from the indoor circuit 116 to the outdoor circuit 136, but this comes at the price of large amounts of electrical energy.

As noted above, the water in the indoor and outdoor circuits 116 and 136 is circulated therein by one or both of the pumps 118 and 138. In the low power mode, the chiller circuit 126 is shut down, and the valves 162 and 172 are opened to allow water to flow into the conduits 160 and 170 from the indoor and outdoor circuits 116 and 136. Thus, no thermal energy is moved from the indoor circuit 116 to the outdoor circuit 136 through the chiller circuit 126. This saves electrical energy, because the main consumers of energy in the low power mode are the pumps 118 and 138 (only one of which might be used to further save energy), and these pumps use far less electricity than the compressor 120.

During the low power mode when the water flowing in the indoor circuit 116 reaches the valve 162, the water is diverted to the conduit 160. This water has just been warmed by passing through the indoor heat exchanger 114, and the water reaches the outdoor circuit just upstream of the condenser 130. It is preferred in the low power mode for the water to effectively bypass the condenser and flow instead through the bypass 150, as diverted by the valve 155.

After bypassing the condenser 130, the water in the outdoor circuit 136 passes through the outdoor heat exchanger 134 and is cooled. The water then flows to the valve 172, which diverts the water into the conduit 170. The cooled water exits the conduit 170 by entering the indoor circuit 116 just upstream of the evaporator 110 and just downstream of the valve 162. It is possible to bypass the evaporator 110 using a bypass similar to the bypass 150, but this is not necessary. This cooled water is circulated around the indoor circuit 116 and enters the indoor heat exchanger 114 to cool the air inside the building to which the system 100 is operatively connected. This cycle is repeated for as long as the low power mode is called for by the computer 200, based on the conditions. It is possible during the low power mode for the water sprayer 8 to spray water on the outdoor heat exchanger 134 in a conventional manner to further cool the air that contacts the outdoor heat exchanger 134, but this is not required.

The central computer 200 uses pre-programmed algorithms to determine whether the building cooling load requirements can be met by the low power mode in order to save energy. It is contemplated that the system 100 can be switched back and forth between low and high power modes in order to make the system 100 more energy efficient when the conditions permit. Alternatively, or additionally, the medium power mode can be engaged as will now be described.

In the medium power mode, the system differs from the high power mode inasmuch as the valves 162 and 172 are open to divert the water from the indoor circuit 116 to the outdoor circuit 136 as in the low power mode. Additionally, in the medium power mode, the compressor 120 is powered to compress the refrigerant in the chiller circuit 126, but it is preferably powered to operate at a lower level than during the high power mode. For example, the compressor 120 can be driven to operate at about one-quarter, one-third, one-half, three-quarters or some other fraction of the maximum amount of compression of which it is capable. In an example, the compressor 120 is actuated to operate at about one-half of the maximum compression. Thus, the medium power mode is a "hybrid" of the low and high power modes. In the medium power mode, thermal energy is pumped from the indoor circuit 116 to the outdoor circuit 136 through the conduits 160 and 170 and through the chiller circuit 126. The degree of compression can be varied as the system's requirements change.

At the outdoor circuit 136, water enters the circuit just upstream of the condenser 130 via the conduit 160 directly from the indoor circuit 116 and mixes with water flowing around the circuit from the outdoor heat exchanger 134. Some of the water upstream of the condenser 130 can be diverted around the condenser 130 by the valve 155 and the bypass 150 and some can pass through the condenser 130. Alternatively, all water upstream of the condenser 130 can pass completely through the condenser 130. Whether all, some or no water bypasses the condenser 130 is determined by the conditions, as detected by the central computer 200, in various components of the system 100 and in and around the building. In particular, the conditions in the chiller circuit 126 can be detected to determine whether and how much to bypass the condenser 130.

During the medium power mode, as the building load increases and/or as the outdoor conditions reduce the energy efficiency of cooling by bypassing the chiller circuit 116 as in the low power mode, a smaller amount of water bypasses the condenser 130 and the system 100 begins to resemble the high power mode of operation, except that the compressor 120 operates at a lower power level. Similarly, as the building load decreases and/or as the outdoor conditions increase the energy efficiency of cooling by bypassing the chiller circuit 116 as in the low power mode, a larger amount of water bypasses the condenser 130 and the system 100 begins to resemble the low power mode of operation except that the compressor 120 is operating. In this way, the outdoor heat exchanger 134 accomplishes more of the cooling as the outdoor conditions permit, thereby reducing the load on the evaporator 110.

It is preferred that in the medium power mode, the water sprayer 8 is used to further cool the outdoor heat exchanger 134, particularly as the weather conditions warrant. Thus, the medium power mode increases the energy efficiency of the system 100 over the high power mode while pumping larger amounts of thermal energy out of the building than the low power mode.

As noted, the valves 162, 172 and 155 are opened and closed completely or to varying degrees as controlled by the central computer 200 that senses conditions inside and outside the building 101. When the indoor and outdoor water circuits 116 and 136 are connected by the conduits 160 and 170, the water in the indoor circuit 116 that has been warmed by absorbing heat from the indoor air flows to the outdoor circuit 136 and flows either through the condenser 130 or bypasses the condenser 130. Whether the condenser 130 is bypassed is determined by the greatest efficiency in operation. The water flows into the outdoor heat exchanger 134 and releases heat to the outdoors, then flows through the conduit 170 back to the indoor circuit 116 just upstream of the evaporator 110 where the water releases heat to the refrigerant (if the chiller circuit 126 is in operation). The water, cooled in the outdoor heat exchanger, flows through the indoor heat exchanger 114, thereby cooling the indoor air. This cycle repeats and can be varied based upon changing conditions, electricity costs and/or preferences.

The pump 118 for the indoor circuit 116 can vary the flow of the heat transfer fluid through the indoor air heat exchanger 114 or the flow can remain constant. The pump 138 for the outdoor circuit 136 can vary the flow of the heat transfer fluid through the indoor air heat exchanger 134 or the flow can remain constant. Flow variation within a circuit can take place by changing the speed of the pumps 118 and 138 or by using separate, variable speed pumps that distribute fluid to the heat exchangers 114 and 134. Thus, in some circumstances the pumps 118 and 138 do not impel fluid to the heat exchangers 114 and 134, but the variable speed pumps do.

Additionally, it should be noted that the fluid flows in the circuits 116 and 136 are typically different, and the pressures in the circuits vary as does the pressure produced by the pumps 118 and 138. As shown in FIG. 2, hydraulic bridges between the connections 160 and 170 at the indoor circuit and the outdoor circuit allow bypassing of fluid flow and pressure so that the pumps 118 and 138 can act independently, if desired.

This detailed description in connection with the drawings is intended principally as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention and that various modifications may be adopted without departing from the invention or scope of the following claims.

The invention claimed is:

1. An improved cooling system for transferring heat from indoor air in an interior of a building to outdoor air outside of the building including a chiller circuit having at least a compressor, an expansion device, an evaporator and a condenser connected in a chiller enclosed loop by conduits through which refrigerant flows, an indoor fluid circuit having conduits forming an indoor enclosed loop through which a first cooling fluid flows, the indoor fluid circuit having at least a first heat exchanger across which indoor air is directed and through which the first cooling fluid flows, wherein the first cooling fluid flows through the evaporator, and an outdoor fluid circuit having conduits that form no part of the indoor enclosed loop forming an outdoor enclosed loop through which a second cooling fluid flows, the outdoor fluid circuit having at least a second heat exchanger across which outdoor air is directed and through which the second cooling fluid flows without contacting, or mixing with, the outdoor air, wherein the second cooling fluid flows through the condenser, the improvement comprising:

(a) a first fluid conduit that is outside of the chiller enclosed loop, the indoor enclosed loop, and the outdoor enclosed loop, the first fluid conduit extending from a first point of the indoor fluid circuit to a second point of the outdoor fluid circuit to permit the first cooling fluid to flow to the outdoor enclosed loop; and (b) a second fluid conduit that is outside of the chiller enclosed loop, the indoor enclosed loop, and the outdoor enclosed loop, the second fluid conduit extending from fluid communication with a third point on the outdoor fluid circuit to fluid communication with a fourth point on the indoor fluid circuit to permit the second cooling fluid to flow to the indoor enclosed loop;

wherein said at least the second heat exchanger of the outdoor fluid circuit is disposed outside of the building, and all flow paths for fluids in the outdoor fluid circuit extend from the second point to the third point through the second heat exchanger and optionally through the condenser.

2. The improved cooling system in accordance with claim 1, further comprising:

(a) a first valve in the indoor fluid circuit that directs at least some of the first cooling fluid in the indoor fluid circuit into the first fluid conduit; and (b) a second valve in the outdoor fluid circuit that directs at least some of the second cooling fluid in the outdoor fluid circuit into the second fluid conduit.

3. The improved cooling system in accordance with claim 2, further comprising:

(a) a bypass valve mounted in the outdoor fluid circuit upstream from the condenser; and (b) a bypass in the outdoor fluid circuit, the bypass extending around the condenser from downstream of the bypass valve to downstream of the condenser to permit at least some of the fluid in the outdoor fluid circuit to bypass the condenser.

4. The improved cooling system in accordance with claim 3, further comprising a central computer connected to the first and second valves and receiving at least weather condition data that are used to selectively open and close the first and second valves.

5. The improved cooling system in accordance with claim 4, wherein the central computer is connected to the bypass valve to open and close the bypass valve.

* * * * *